US009123293B2

(12) United States Patent
Mizukoshi et al.

(10) Patent No.: US 9,123,293 B2
(45) Date of Patent: Sep. 1, 2015

(54) DISPLAY DEVICE

(75) Inventors: Seiichi Mizukoshi, Chigasaki (JP); Makoto Kohno, Yokohama (JP); Kouichi Onomura, Tokyo (JP)

(73) Assignee: Global OLED Technology LLC, Herndon, VA (US)

( * ) Notice: Subject to any disclaimer, the term of this patent is extended or adjusted under 35 U.S.C. 154(b) by 444 days.

(21) Appl. No.: 13/264,339

(22) PCT Filed: Apr. 22, 2010

(86) PCT No.: PCT/US2010/032028

§ 371 (c)(1),
(2), (4) Date: Mar. 9, 2012

(87) PCT Pub. No.: WO2010/124071

PCT Pub. Date: Oct. 28, 2010

(65) Prior Publication Data

US 2012/0176397 A1 Jul. 12, 2012

(30) Foreign Application Priority Data

Apr. 23, 2009 (JP) ..... 2009-104614

(51) Int. Cl.

| | |
|---|---|
| ***G09G 3/30*** | (2006.01) |
| ***G09G 3/32*** | (2006.01) |
| *G09G 3/20* | (2006.01) |
| *G09G 5/39* | (2006.01) |

(52) U.S. Cl.

CPC ..... *G09G 3/3233* (2013.01); *G09G 3/3275* (2013.01); *G09G 3/2055* (2013.01); *G09G 3/2092* (2013.01); *G09G 5/39* (2013.01); *G09G 2300/0842* (2013.01); *G09G 2310/027* (2013.01); *G09G 2320/0233* (2013.01); *G09G 2320/0247* (2013.01); *G09G 2320/0285* (2013.01); *G09G 2320/043* (2013.01); *G09G 2320/0673* (2013.01); *G09G 2360/16* (2013.01); *G09G 2360/18* (2013.01)

(58) Field of Classification Search

CPC ..... G09G 2320/043; G09G 2320/0285; G09G 2320/0673; G09G 3/3225; G09G 3/2055; G09G 2300/0842; G09G 2360/16; G09G 2360/18

USPC ..... 345/76–83, 87, 89, 690; 315/169.3

See application file for complete search history.

(56) References Cited

U.S. PATENT DOCUMENTS

| | | | | |
|---|---|---|---|---|
| 2006/0066643 | A1 | 3/2006 | Arai et al. | |
| 2006/0214940 | A1 | 9/2006 | Kinoshita | |
| 2006/0256058 | A1 * | 11/2006 | Asano et al. | 345/92 |
| 2007/0091107 | A1 | 4/2007 | Miyazawa | |
| 2007/0273701 | A1 | 11/2007 | Mizukoshi et al. | |
| 2010/0171774 | A1 * | 7/2010 | Mizukoshi et al. | 345/690 |

FOREIGN PATENT DOCUMENTS

| | | | |
|---|---|---|---|
| JP | 200786678 | | 5/1998 |
| JP | 2004-264793 | A | 9/2004 |
| JP | 2005-284172 | A | 10/2005 |
| JP | 3887826 | B2 | 12/2006 |

* cited by examiner

*Primary Examiner* — Jimmy H Nguyen

(74) *Attorney, Agent, or Firm* — Global OLED Technology LLC

(57) ABSTRACT

The rate of reading from a memory for storing display irregularity correction data is lowered. At the time of display, calculation is carried out in a correction calculation section 12 using an input signal and correction data in RAM 22, and brightness inconsistency correction is carried out. The way in which correction calculation is carried out in the correction calculation section 12 is changed for every frame.

3 Claims, 16 Drawing Sheets offset = k(b' –ab/a' )
gain = a/a'
HERE, k DENOTES THE D/A CONVERSION COEFFICIENT.

DISPLAY DEVICE

This application is a National Stage Entry of International Application No. PCT/US2010/032028, filed Apr. 22, 2010, and claims the benefit of Japanese Application No. 2009-104614, filed on Apr. 23, 2009, which is hereby incorporated by reference for all purposes as if fully set forth herein.

BACKGROUND OF THE INVENTION

1. Field of the Invention

The present invention relates to correction of brightness irregularities in a display device.

2. Description of the Related Art

FIG. 1 shows the structure of a circuit for one pixel section (pixel circuit) of a basic active organic EL display device, and FIG. 2 shows the structure and input signals of a display panel.

A data signal is written to a storage capacitor C by setting a gate line (Gate), that extends in the horizontal direction), to a high level to turn an n-channel selection TFT 2 on, and in this state placing a data signal (image data) having a voltage corresponding to a display brightness on a data line (Data) that extends in the vertical direction. In this way, a gate of a p-channel drive TFT 1 is set to a voltage corresponding to the data signal, drive current corresponding to the data signal is supplied to an organic EL element, and the organic EL element emits light.

In FIG. 2, pixel data, a horizontal sync signal (HD), a pixel clock and other drive signals are supplied to a source driver. The pixel data signal is sent to the source driver in synchronism with the pixel clock, held in an internal latch circuit once a single horizontal line of pixels have been acquired, and subjected to D/A conversion all at once to supply to a data line (Data) of a corresponding row. Also, the horizontal sync signal (HD), other drive signals and a vertical sync signal (VD) are supplied to a gate driver. The gate driver performs control to sequentially turn on gate lines (Gate) arranged horizontally along each line, so that image data is supplied to pixels of the corresponding line. The pixel circuit of FIG. 1 is provided in the pixel sections that are arranged in a matrix shape. Also, a power supply line PVDD is arranged in the vertical direction along a pixel row, and CV is connected to a power supply CV with cathodes of the organic EL element provided common to all pixels.

As a result of this type of structure, data is sequentially written to each pixel in horizontal line units, and display is carried out at each pixel in accordance with the written data, to perform image display as a panel.

Here the amount of light emission and current of the organic EL element are in a substantially proportional relationship. Normally, a voltage (Vth) is supplied across the gate of the drive TFT and PVdd such that a drain current approaching that for a black level of the pixel starts to flow. Also, the amplitude of the image signal is an amplitude so as to give a prescribed brightness close to a white level.

FIG. 3 shows a relationship for current "CV current" (corresponding to brightness) flowing in the organic EL element with respect to input signal voltage (voltage of the data line Data) of the drive TFT. It is possible to carry out appropriate gradation control for the organic EL element by determining the data signal so that Vb is supplied as the black level voltage and Vw is supplied as the white level voltage.

Specifically, the brightness when the pixel is driven at a particular signal voltage differs depending on the threshold voltage (Vth) of the drive TFT, and an input voltage close to PVdd (power supply voltage)−Vth (threshold voltage) corresponds to a signal voltage when displaying black. Also, the slope (μ) of the V-I curve of a TFT varies in a similar manner, and in this case, as shown in FIG. 4, an input amplitude (Vp−p) for outputting the same brightness is also different.

If there are variations in Vth and μ of the TFT inside the panel, there will usually be inconsistencies in brightness. With the objective of correcting these brightness inconsistencies, panel current flowing when lighting up each pixel at a number of signal levels is measured, to obtain a V-I curve for individual TFTs.

A correction data calculation method is shown in FIG. 5. First, a V-I characteristic curve for standard pixels of the panel is obtained by measuring a voltage to current characteristic for a number of pixels. It is assumed that this curve is represented by an equation such as Id=f(a(Vgs−b)), and a function f(x) is determined. A characteristic for all pixels of the panel is represented by this f(x), and if it is assumed that variation in characteristic is due to difference between a coefficient a and a coefficient b, a and b for each pixel can be obtained by measuring pixel current corresponding to two or more input voltage levels.

When the V-I characteristic of a pixel p is represented by Id=f(a'(Vgs−b')), correction is carried out by first obtaining offset=k(b'−ab/a') and gain=a/a' using a and b of previously obtained average pixels, with k as a D/A conversion coefficient, and the image data is then multiplied by the obtained gain and added to offset.

In the case of carrying out this type of processing, as shown in FIG. 6, first γ correction is carried out in a γ look up table (LUT) in order to compare relationships between pixel data and pixel current for image data (R signal, G signal and B signal), and image data that has been γ corrected is obtained. Next, image data after γ correction is multiplied bγ correction gain in a correction calculation section 12, and irregularities are corrected by adding the correction offset.

Image data (R, G, B) for which irregularity has been corrected is supplied to the display panel 14, where it is displayed. Here, correction gain and correction offset for every pixel is stored in a memory section such as RAM, read out in synchronism with image data, and used in correction of the image data.

PRIOR ART REFERENCES

Patent Publications

Patent document 1: JP No. 3887826B
Patent document 2: JP No. 2004-264793A
Patent document 3: JP No. 2005-284172A
Patent document 4: JP No. 2007-86678A

DISCLOSURE OF THE INVENTION

Here, if a case of driving a panel of VGA size is considered, a data rate of reading from a RAM storing correction data can be calculated as follows.

First, a total number of dots of an image to be displayed is:

$$\text{total No. of dots}=\text{length}\times\text{width}\times RGB=480\times640\times3=921{,}600$$

Accordingly, if a screen is updated at 60 Hz, it is necessary to transmit correction data for 921,600 dots in one frame, or 1/60th of a second. The data rate for correction data therefore becomes 921,600×60=55,296,999=55.296 MHz, or more. If values for correction offset and correction gain are respectively made 8 bits, then in the case of using a RAM of 16 bit width it becomes necessary to read out data at a read rate of 55.296 MHz or higher. Also, with a higher resolution display a faster read rate will be required.

Taking into consideration cost and simplification of the circuitry, it is desirable to directly read out data from a non-volatile memory such as flash memory in synchronism with the pixel data, and at this point it time it is not possible for the read rates of standard flash memory to satisfy the above needs, and omitting RAM is difficult. To lower read rate, it is necessary to implement an increase in the bit width or the like, which impacts on the cost and substrate area etc.

It is also desirable to lower the frequency of memory read from the viewpoint of wasteful radiation problems and power consumption. In patent document 4, direct data reading from a flash memory having a high-speed serial interface is implemented.

SUMMARY OF THE INVENTION

The present invention is characterized by a display device having an inconsistency correction function, for storing correction data for correcting variations in brightness for each pixel, and at the time of display, performing calculation using input signals and the stored correction data, and performing correction of brightness inconsistency.

The present invention also preferably performs correction calculations for each pixel only once for a plurality of frames.

It is also preferable to vary the position of pixels that are the subject of correction for every frame.

It is also preferable to divide a display region into small regions of n (where n is an integer of 2 or more) pixel units, to correct of n/m pixels (where m is an integer of 2 or more) within each small region for every one frame, and correct display pixels in m frames.

It is also preferable to divide the display region into small regions of n (n is an integer of 2 or more) unit pixels, provide a memory for respectively storing average values Av of correction values for n pixels of the small region and correction values y for each pixel with the small region, and to have frames where correction calculation for each pixel is performed using the average values Av and frames where the correction calculation for each pixel is performed using the correction values y.

It is also preferable to divide the display region into small regions of n (n is an integer of 2 or more) unit pixels, provide a memory for respectively storing average values Av of correction values for n pixels of the small region and z derived from computation of average values Av of correction values for n pixels and correction values y for each pixel within the small region, and to have frames where correction calculation for each pixel is performed using the average values Av and frames where the correction calculation for each pixel is performed using correction values y that are derived from reverse computation of the computation of the average values Av and z.

It is also preferable for the small region to have a plurality of pixels on a horizontal scanning line.

Effect of the Invention

According to the present invention, the manner of correction is changed for every frame. As a result, correction is completed in a plurality of frames and it is possible to lower the read frequency of correction data.

DESCRIPTION OF THE PREFERRED EMBODIMENTS

Embodiments of the present invention will be described in the following based on the drawings. As the simplest example, correction of image data is not carried out for every frame for all pixels, and instead the pixels are divided into a plurality (m) of groups, and correction is carried out for each group sequentially for every frame. In this case, correction values are determined such that average brightness for m frames of each pixel becomes a target brightness. For example, in a case where an image of a brightness level that is fixed over the entire panel is displayed, brightness of respective pixels varies only once in m frames, but when m is small, or there is only slight brightness inconsistency, to the human eye brightness variation for every frame is imperceptible, and appears uniform. Specifically, when m is small, it is possible to lower memory read speed to 1/m, without any significant difference in visual appearance from the related art where correction is carried out in all frames.

Figure 7:
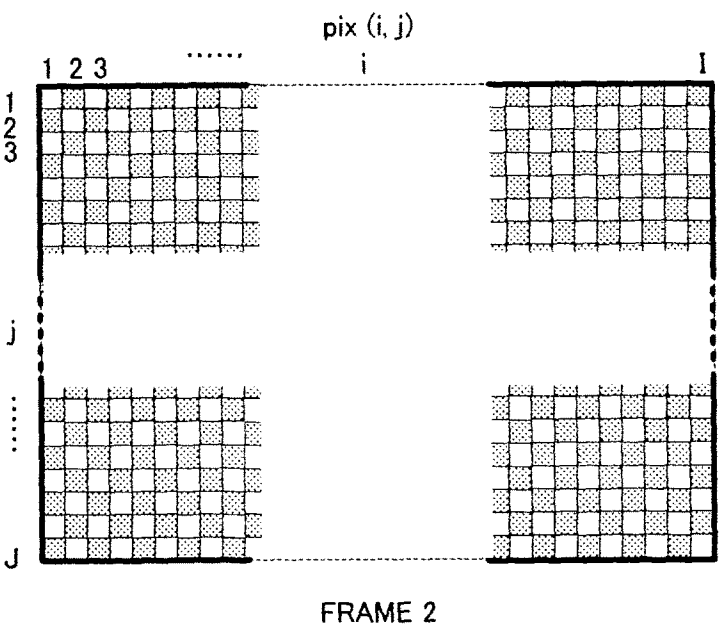
FIG. 7 is a drawing showing one example of pixels where correction is carried out.
Figure 7:
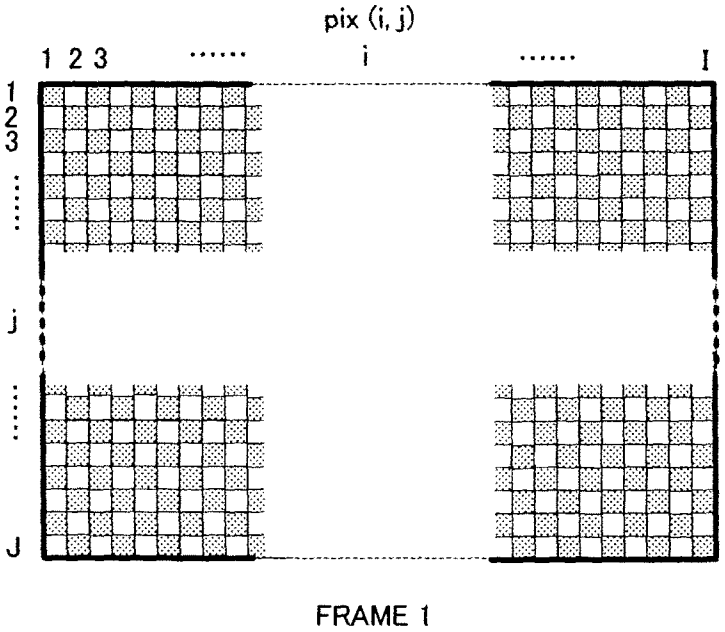
Figure 8:
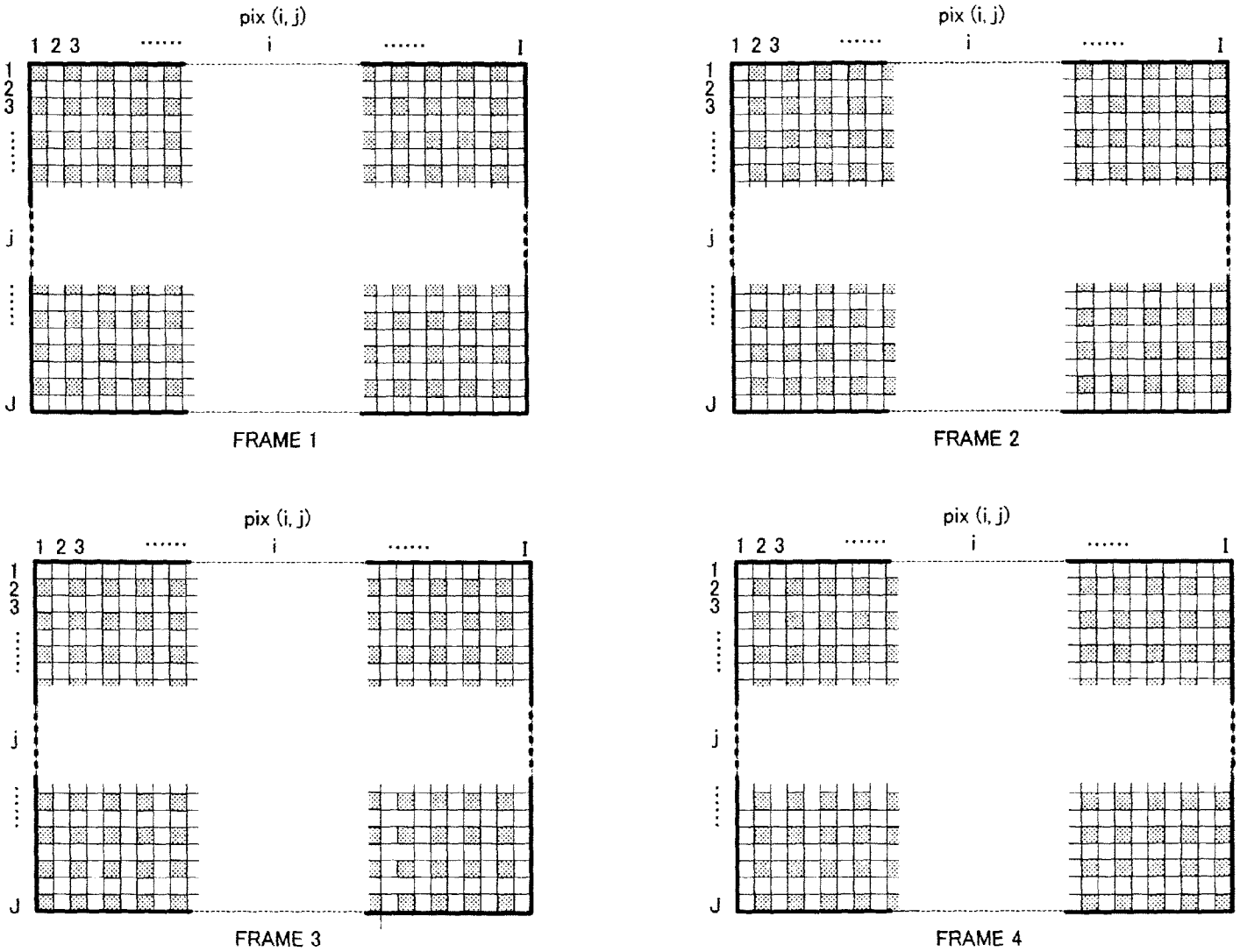
FIG. 8 is a drawing showing another example of pixels where correction is carried out.

FIG. 7 and FIG. 8 are drawings showing positions of corrected pixels in each frame, in the cases where m is respectively 2 and 4, as grey. As shown, by varying positions of pixels to be corrected according to frame, flicker is made difficult to see.

Figure 9:
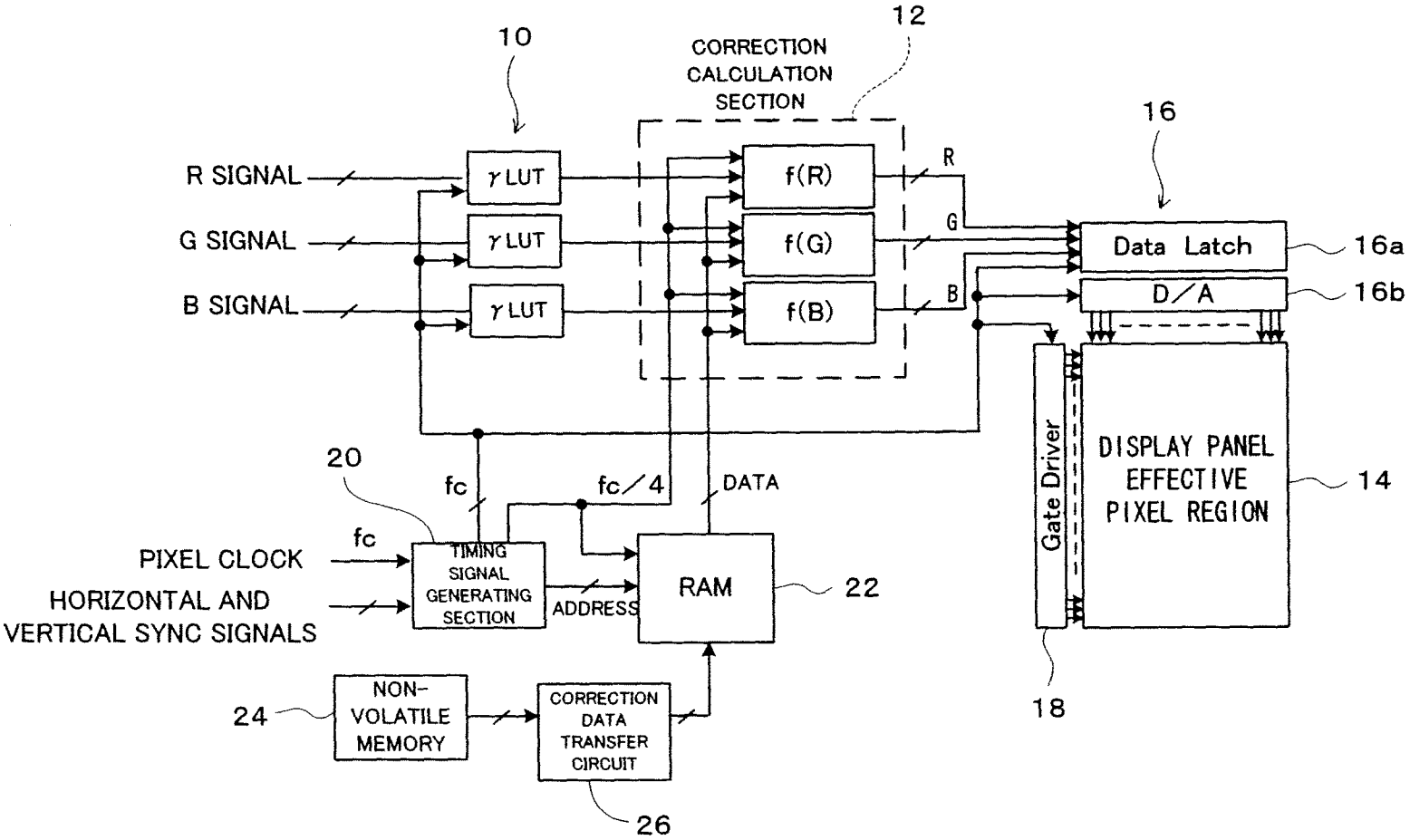
FIG. 9 is a block diagram showing the structure of an embodiment.

FIG. 9 is a block diagram showing the structure of a display device when m=4. An R signal, G signal and B signal, being image data, are respectively input to γ look up tables 10 (γ LUT: 10R, 10G, 10B). This γ look up table 10 performs γ correction in order to make a relationship between pixel data and pixel current linear, and image data that has been γ corrected is obtained using the γ look up table 10. Image data after this γ correction is supplied to a correction calculation section 12 (correction calculation blocks 12R, 12G and 12B), where respective correction calculation is carried out for RGB image data, and the RGB image data after correction is output.

In this embodiment, this type of correction is then carried out for only one pixel within four pixels, and pixel data of the remaining three pixels passes through unchanged having not undergone correction calculation. The pixels for which correction is performed are then changed for every frame, and correction of all pixels is carried out in four frames.

In this way, with the resultant intermittent processing image data (R, G, B) that has had inconsistency corrected is supplied, by way of a source driver 16 that includes a data latch 16*a* and a D/A converter 16*b*), to the display panel 14 where it is displayed. A gate driver 18 is connected to the display panel 14, and this gate driver 18 controls to what line of the display panel 14 image data is supplied to.

Figure 1:
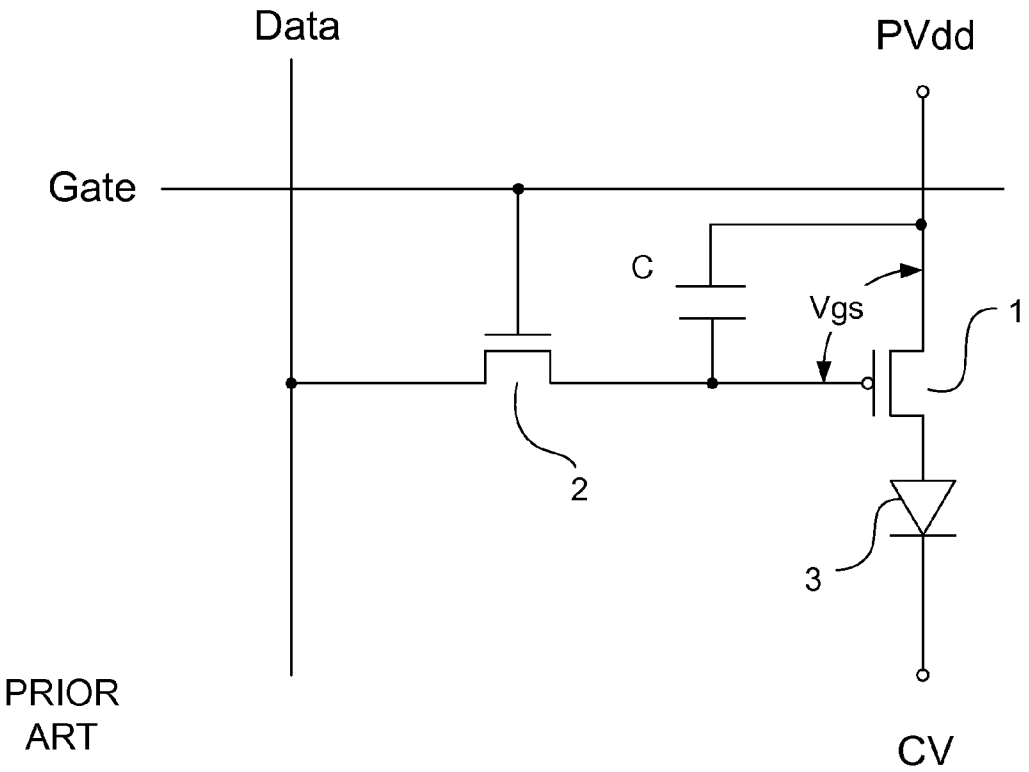
FIG. 1 is a drawing showing the structure of a pixel circuit.
Figure 2:
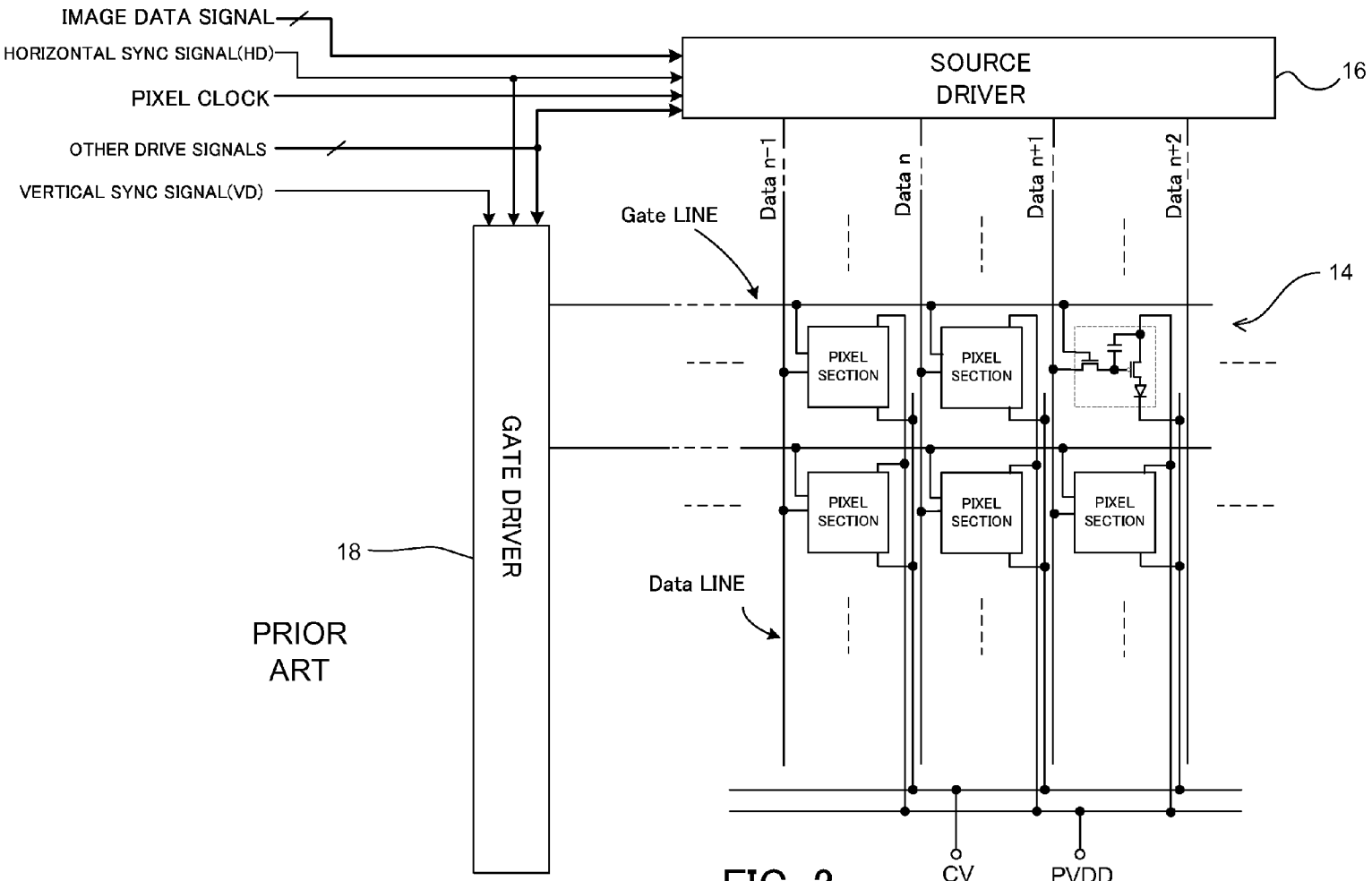
FIG. 2 PRIOR ART
FIG. 2 is a drawing showing the structure of a display panel.
Figure 3:
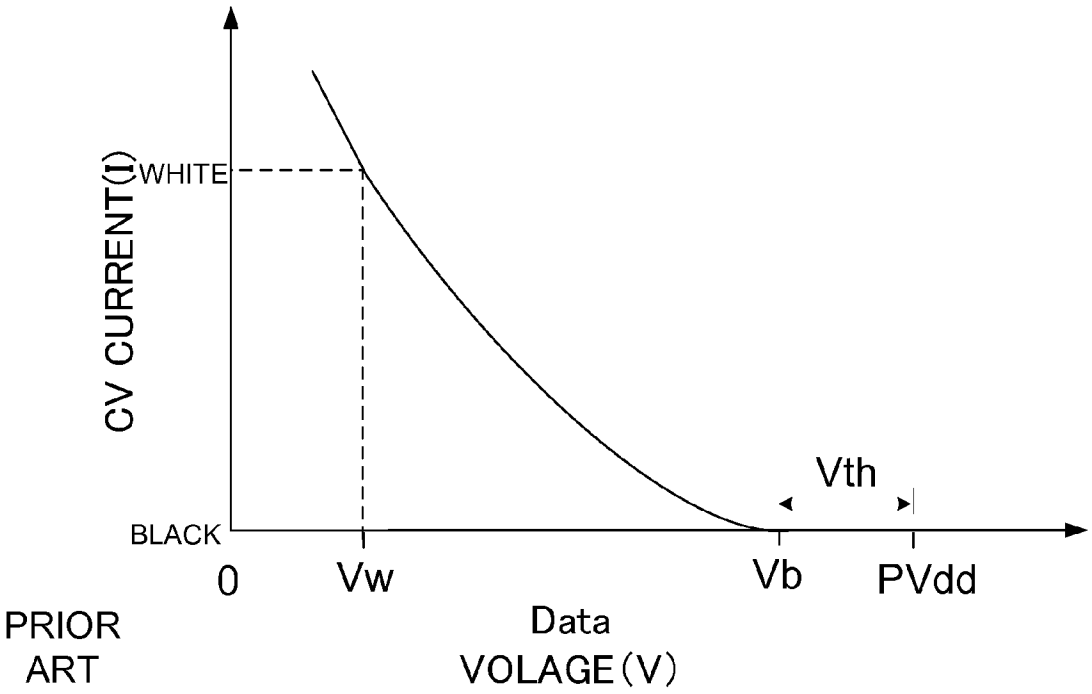
FIG. 3 is a drawing showing a relationship between data voltage and drive current.
Figure 4:
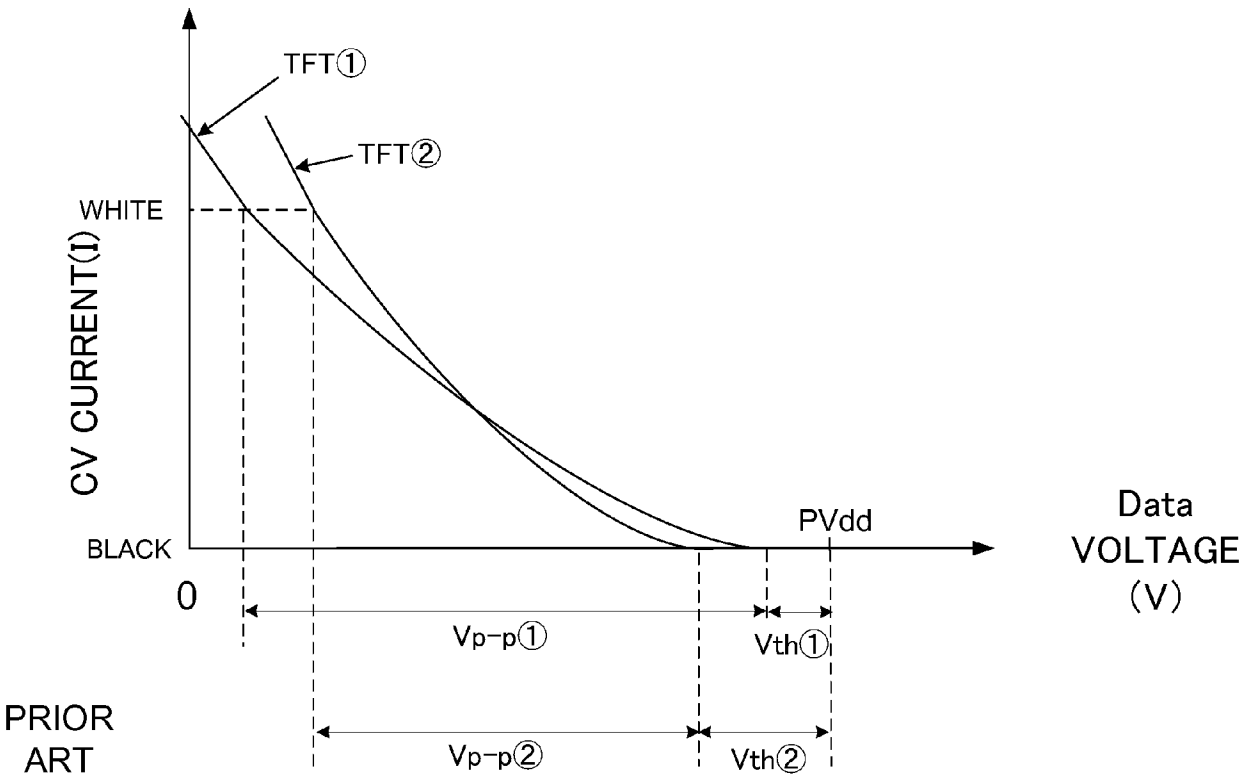
PRIOR ART FIG. 4
FIG. 4 is a drawing showing drive current difference for drive transistors.
Figure 5:
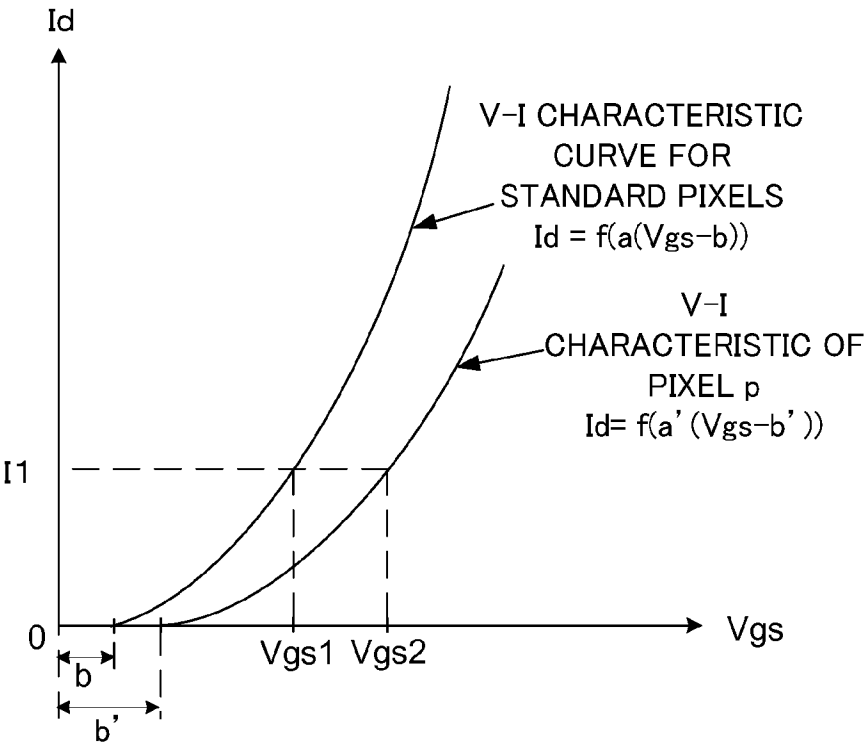
PRIOR ART FIG. 5
FIG. 5 is a drawing showing V-I characteristics for a pixel.
Figure 6:
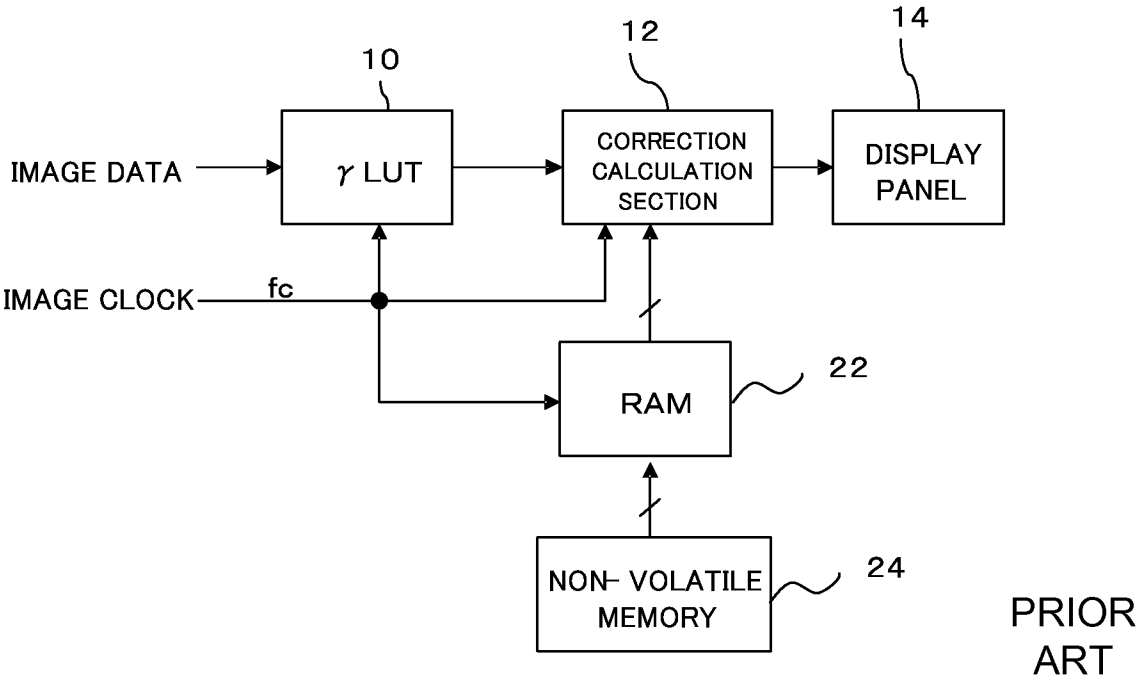
PRIOR ART FIG. 6
FIG. 6 is a drawing showing a structure for correction of image data.

The display panel 14 has the structure as shown in FIG. 2, and each pixel has the structure as shown in FIG. 1. Accordingly, an organic EL element of each pixel emits light based on analog image data supplied from the D/A converter 16, and display on the display panel 14 is carried out.

Here, a timing signal generating section 20 generates various timing signals from a pixel clock, and horizontal and vertical synchronization signals, and generates addresses of the RAM 22 where correction data is being stored. This RAM 22 is constructed of SDRAM or DRAM that is capable of reading and writing at high speed, and when power is turned on correction data (gain, offset) is transmitted from external non-volatile memory 24 etc. Flash memory or the like is used as the non-volatile memory 24, and from the viewpoint of cost and size serial output type is often used. In accordance with image data for every pixel, the timing generating section 20 generates addresses where correction data for that pixel is stored, the correction data for the pixel is read from the RAM 22, and this correction data is supplied to the correction calculation section 12. In this embodiment, this correction calculation is performed once in four frames, as described above. Accordingly, reading from the RAM 22 is carried out at ¼ the frequency compared to when carrying out correction in every frame. In the case where m=2, correction data is read out, correction calculation is carried out only once in two frames, and this can be handled with a similar structure.

Next, a description is given of correction calculation in the correction calculation section 12. If characteristic coefficients of an average pixel are made a and b, and characteristic coefficients of a particular pixel are made a1 and b1, then correction values respectively become as follows for the cases of M=2 and 4.

The Case of m=2

In the case where a particular pixel is corrected once in two frames, in order to make the average brightness equal to the brightness of a standard pixel, it is preferable to input Vgs2 as included in equation 1 to the panel. Here, Vgs1 is a voltage across the source and drain of a drive transistor that is not corrected, and Vgs2 is a corrected voltage. The uncorrected voltage Vgs1 across the source and drain of the drive transistor corresponds to image data of subject pixels, and the corrected voltage Vgs2 across the source and drain of the drive transistor corresponds to image data after correction.

$$\{f(a_1(Vgs_1-b_1))+f(a_1(Vgs2-b_1))\}/2=f(a(Vgs_1-b)) \quad \text{Equation 1}$$

Here, in the case of representing as $f(x)=x^C$, equation 1 is expressed as equation 2.

$$\{a_1{}^C(Vgs_1-b_1)^c+a_1{}^c(Vgs_2-b_1)c\}=2a^c(Vgs_2-b_1)^c \quad \text{Equation 2}$$

From this, equation 3 is derived.

$$Vgs_2=\{2a^c(Vgs_1-b)^c-a_1{}^c(Vgs_1-b_1)c\}^{1/c}/a_1+b_1 \quad \text{Equation 3}$$

The Case of m=4

In the case where a particular pixel is corrected once in four frames, in order to make the average brightness equal to the brightness of a standard pixel, it is preferable to input Vgs2 as included in equation 4 to the panel.

$$\{3f(a_1(Vgs_1-b_1))+f(a_1(Vgs_2-b_1))\}/4=f(a(vgs_1-b) \quad \text{Equation 4}$$

Here, in the case of representing as $f(x)=x^c$, equation 4 is expressed as equation 5.

$$\{3a_1{}^c(Vgs_1-b_1)^c+a_1{}^c(Vgs_2-b_1)^c\}=4a^c(Vgs_1-b)^c \quad \text{Equation 5}$$

From this, equation 6 is derived.

$$Vgs^2=\{4a^c(Vgs_1-b)^c-3a_1{}^c(Vgs_1-b_1)^c\}^{1/c}/a^1+b^1 \quad \text{Equation 6}$$

By correcting image data every m frames in accordance with these equations, it is possible to reduce brightness inconsistency.

Specifically, in this embodiment image data is carried out only once for every m frames, for individual pixels, in the correction calculation section 12. This correction therefore corresponds to a correction amount where average correction amount for m frames is normal. Specifically, by carrying out correction once in m frames using a correction amount for m frames, necessary correction is carried out as an average for m frames.

For example, in the case where display for 60 frames is carried out for one minute, with correction once in two frames the human eye recognizes average brightness, and there is hardly any sensation of flickering. Therefore, according to this embodiment, frequency of occurrence of correction is reduced, and a sufficient correction effect is obtained, while making it possible to reduce read speed of the correction data.

Further Embodiment

In the above equations, a coefficient c normally has a value between 2 and 3, and hardware to implement equations 3 to 3 is quite complicated. Therefore, circuitry can be simplified by making the correction values are comparatively small, and using approximate correction coefficients obtained by computing up to first order term of the equations that have been Taylor expanded as follows. When uneven levels are not so large, inconsistency can be significantly improved even with this type of rough approximation.

The Case of m=2

$$Vgs_2=\{2a(Vgs_1-b)-a_1(Vgs_1-b_1)\}/a_1+b_1=Vgs_1(2a-a_1)/a_1-s(ab-a_1b_1)/a_1 \quad \text{Equation 6}$$

Figure 10:
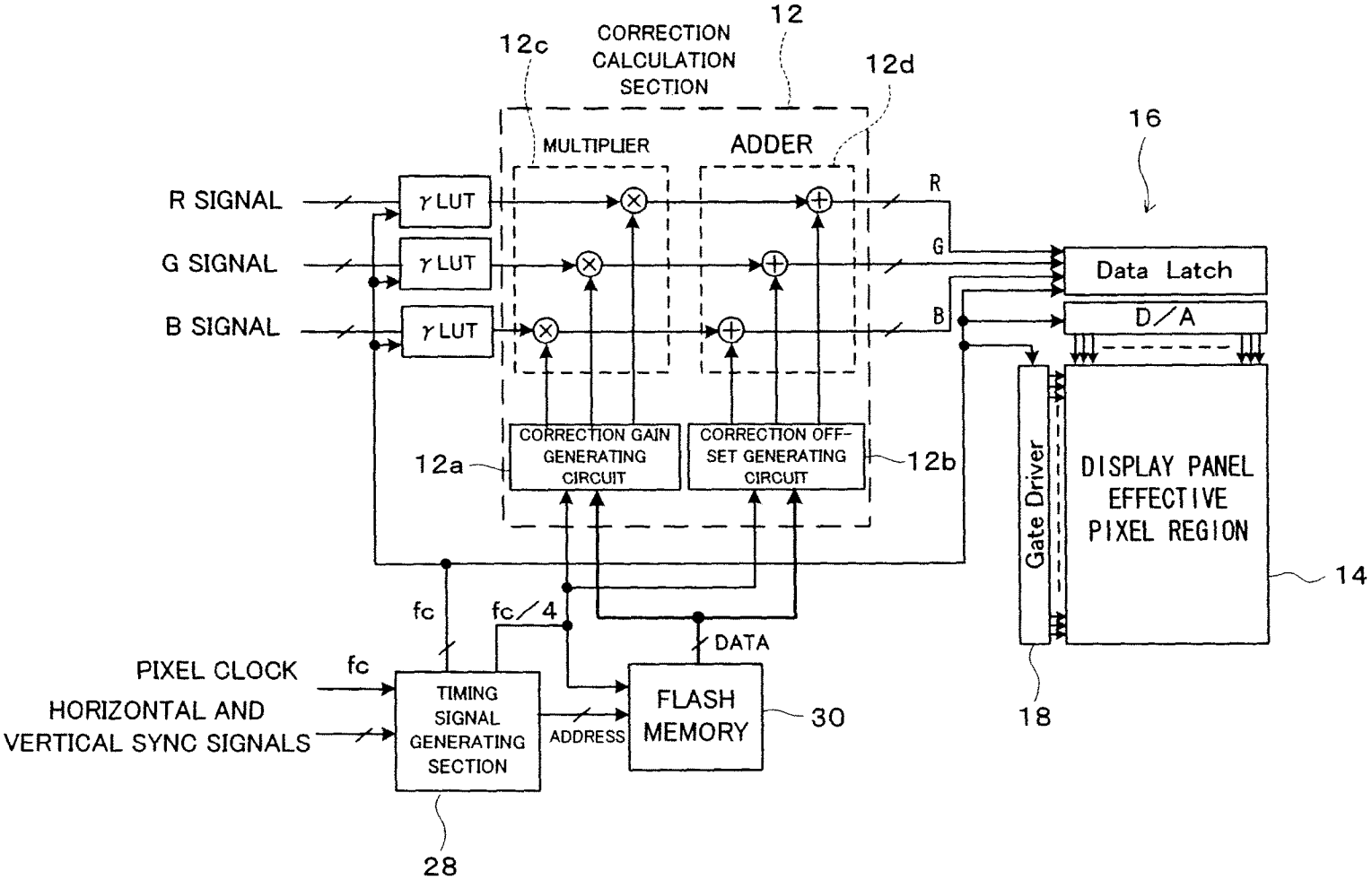
FIG. 10 is a block diagram showing the structure of another embodiment.

In this case, with the circuit structure of FIG. 10, correction is preferably carried out using:

$$\text{offset}=2(ab-a_1b_1)/a_1 \quad \text{Equation 7}$$

and $$\text{gain}=1+2(a/a_1-1) \quad \text{Equation 8}$$

The Case of m=4

$$Vgs^2=\{4a(vgs_1-b)3a_1(Vgs_1-b_1)\}/a_1+b_1=Vgs_1\{4a+3a_1\}/a_1-4(ab-a_1b_1)/a_1 \quad \text{Equation 8}$$

In this case, with the circuit structure of FIG. 10, correction is preferably carried out using:

$$\text{offset}=4(ab-a_1b_1)/a_1 \quad \text{Equation 9}$$

and $$\text{gain}=1+2(a/a_1-1) \quad \text{Equation 10}$$

Generally, offset and gain are obtained by $$\text{offset}=m(ab-a_1b_1)/a_1 \quad \text{Equation 11}$$

$$\text{gain}=1+m(a/a_1-1) \quad \text{Equation 12}$$

FIG. 10, shows a block diagram for the case of directly reading correction data from the flash memory 30, when m=4.

In this way, in accordance with address signals from the timing generation circuit 28 and a timing signals (fc/4) that is ¼ the frequency of a pixel clock fc, correction data for each pixel is output from the flash memory 30. The correction calculation section 12 is comprised of a correction gain generating circuit 12*a*, a correction offset generating circuit 12*b*, a multiplier 12*c*, and an adder 12*d*, with gain being calculated in the correction gain generating circuit 12*a*, and offset being calculated in the correction offset generating circuit 12*b*. Correction of data from the look up tables is then carried out by multiplying by gain in the multiplier 12*c*, and adding offset in the adder 12*d*.

If the value of m is made large, brightness difference between frames that are corrected and frames that are not corrected becomes large, and flicker becomes noticeable. In particular, if there is brightness inconsistency that changes slightly over a wide range of a display region, then at certain portions within the screen it is necessary to insert frames that are very different in brightness from the average brightness of the screen overall, and so flicker is extremely noticeable.

In order to improve this, calculation processing is carried out so as to make differences in brightness variation for every frame as small as possible, no matter at what position on the screen.

Figure 11:
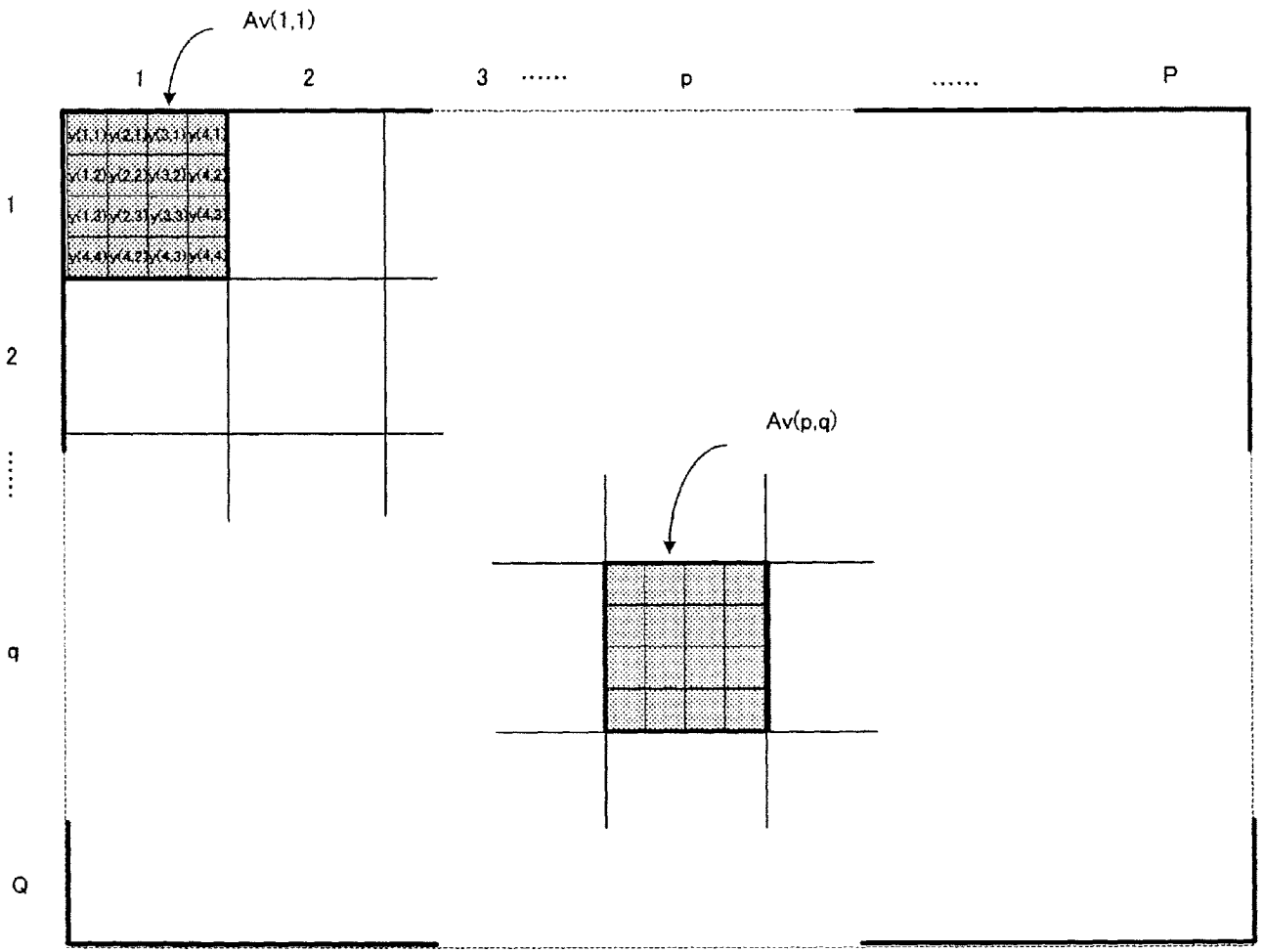
FIG. 11 is a drawing for describing small regions

The above described case where m=4 will be described by way of example. As shown in FIG. 11, a display region is divided into small regions of 4×4 pixels, for example. Averages of correction values for these small regions are stored in memory as Av(p,q). Here, p and q represent positions of a small region. Also, correction values y(i,j) for pixels within that small region are obtained, and similarly stored in memory. Basically, with respect to offset and gain, they are separately calculated as follows.

$$y_\text{offset}(i,j)=\text{offset}(i,j)+3\{\text{offset}(i,j)-\text{Av_offset}(p,q)\} \quad \text{Equation 13}$$

$$y_\text{gain}(i,j)=\text{gain}(i,j)+3\{\text{gain}(i,j)-\text{Av_offset}(p_q)\} \quad \text{Equation 14}$$

Here, y_offset(I,j) and Av_offset(p,q) are respectively correction values y relating to offset of a pixel having coordinates (i,j) and an average Av of correction values of the small region, while gain (i j) and Av_gain(p,q) are respectively correction values y relating to gain of a pixel having coordinates (i,j) and an average Av of correction values for the small region. Offset(i,j) and gain (i,j) are respectively equivalent to offset and gain obtained in equation 9 and equation 10 for the pixel having coordinates (i,j).

Figure 12:
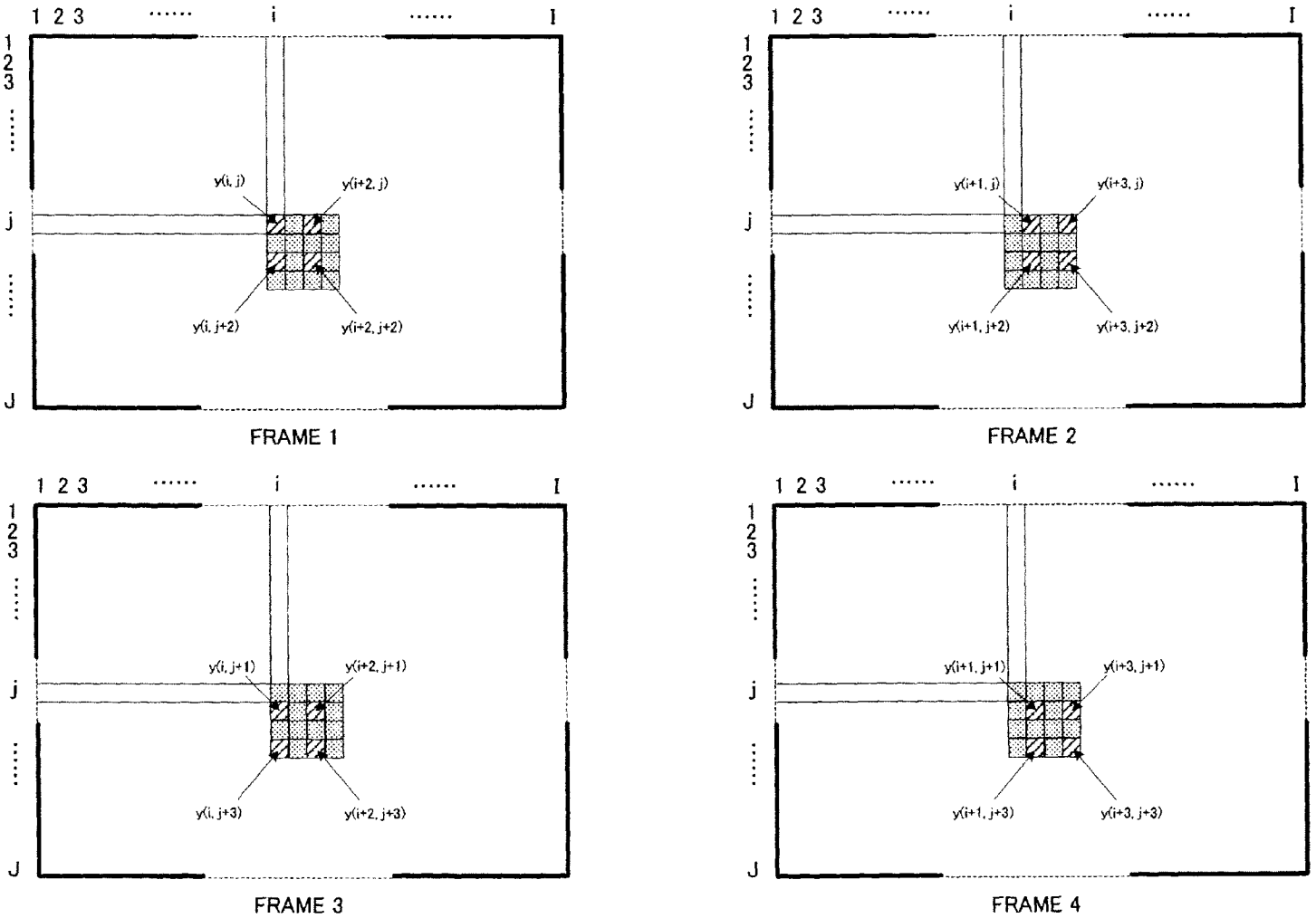
FIG. 12 is a drawing for describing correction of small regions

As shown in FIG. 12, in frame 1, y(i,j), y(i+2,j), y(i,j+2), and y(i+2,j+2) are used as correction values, in frame 2 y(i+1,j), y(i+3,j), y(i+2,j+2), and y(i+3,j+2) are used as correction values, in frame 3 y(i,j+1), y(i+2,j+1), y(I,j+3), and y(i2,j+3) are used as correction values, and in frame 4 y(i+1,j+1), y(i+2,j+1), y(i+1,j+3), and y(i+3,j+3) are used as correction values. In each frame, Av(p,q) is used in another pixel.

Specifically, brightness inconsistency spanning over a wide range on the display screen is corrected every frame with correction date of average values for every small region. This means that only brightness inconsistency between pixels within a small region is corrected every four frames. In this case, the number of correction data items to be stored, if the overall number of pixels is N, is increased by storing Av(p,q), by N/16, but the extent of increase is negligible compared to the original data amount.

Figure 13:
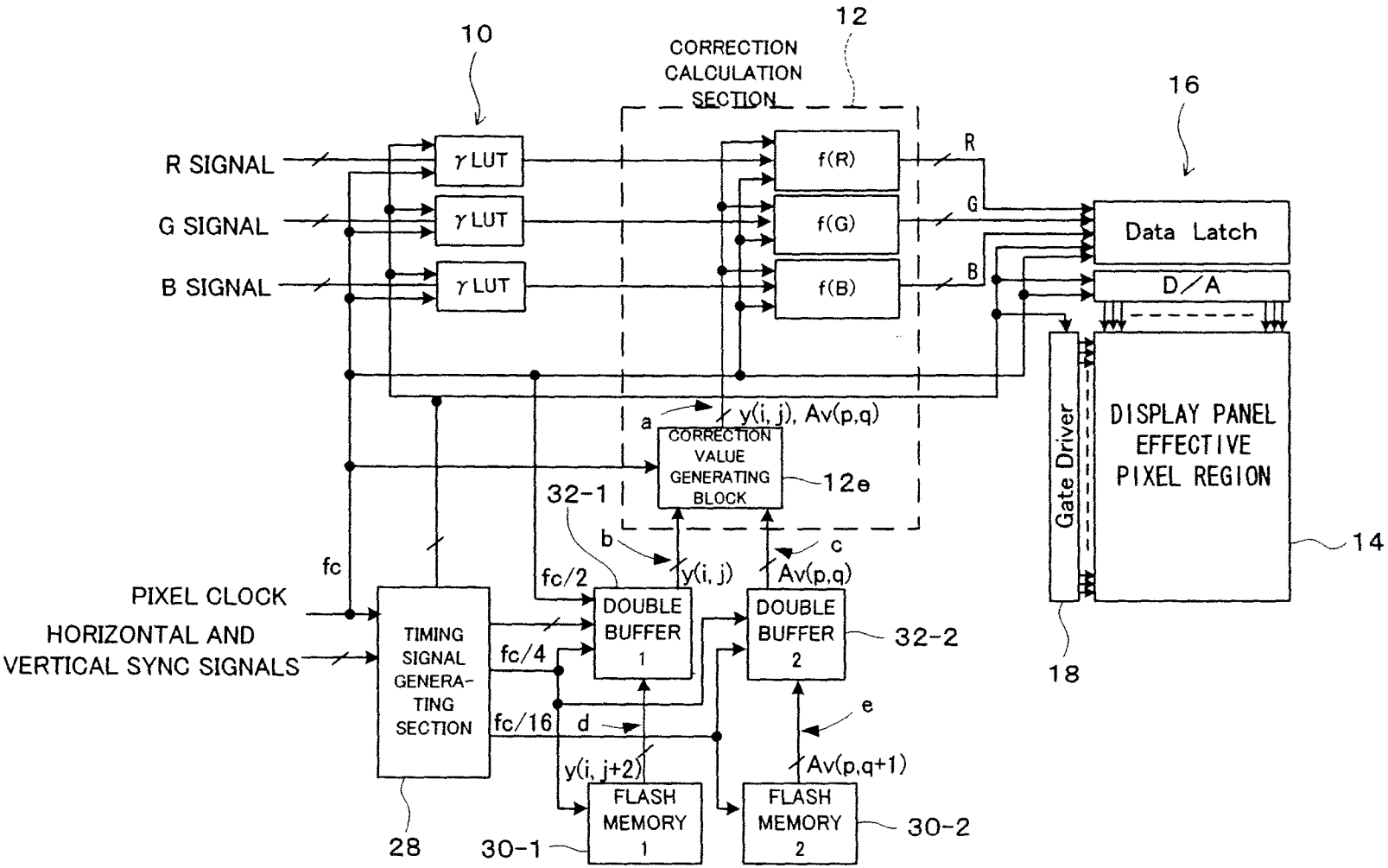
FIG. 13 is a block diagram showing the structure of yet another embodiment.

FIG. 13 is a structural example of this. A flash memory 30-1 stores correction data y(i,j) for each pixel, and a flash memory 30-2 stores average correction data Av(p.q) for small regions. Correction data from the flash memories 30-1 and 30-2 is then supplied via the correction value generating block 12*e* to the correction calculation sections 12R, 12G and 12B.

Figure 14:
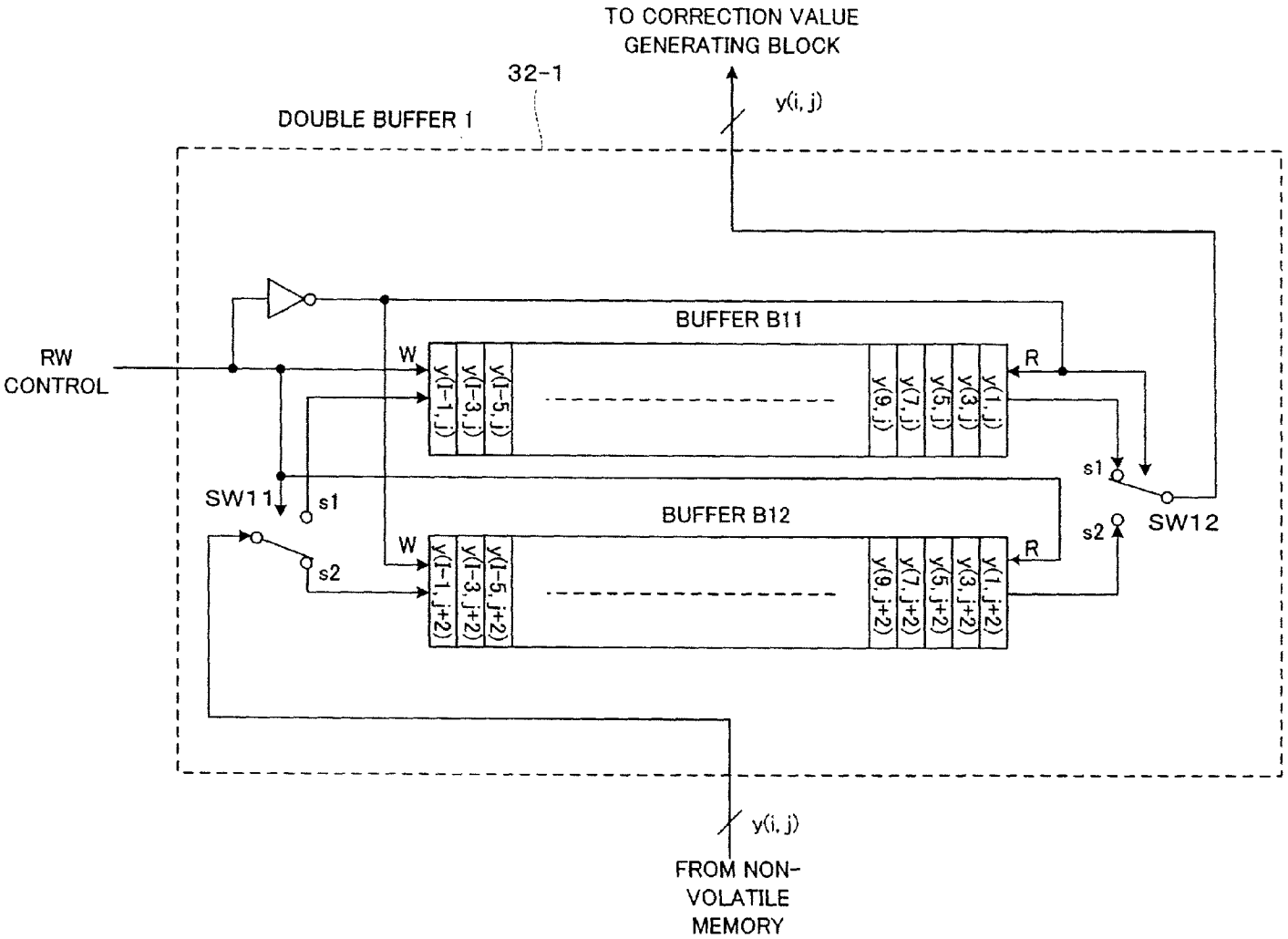
FIG. 14 is a drawing showing the structure of a double buffer 32-1.
Figure 15:
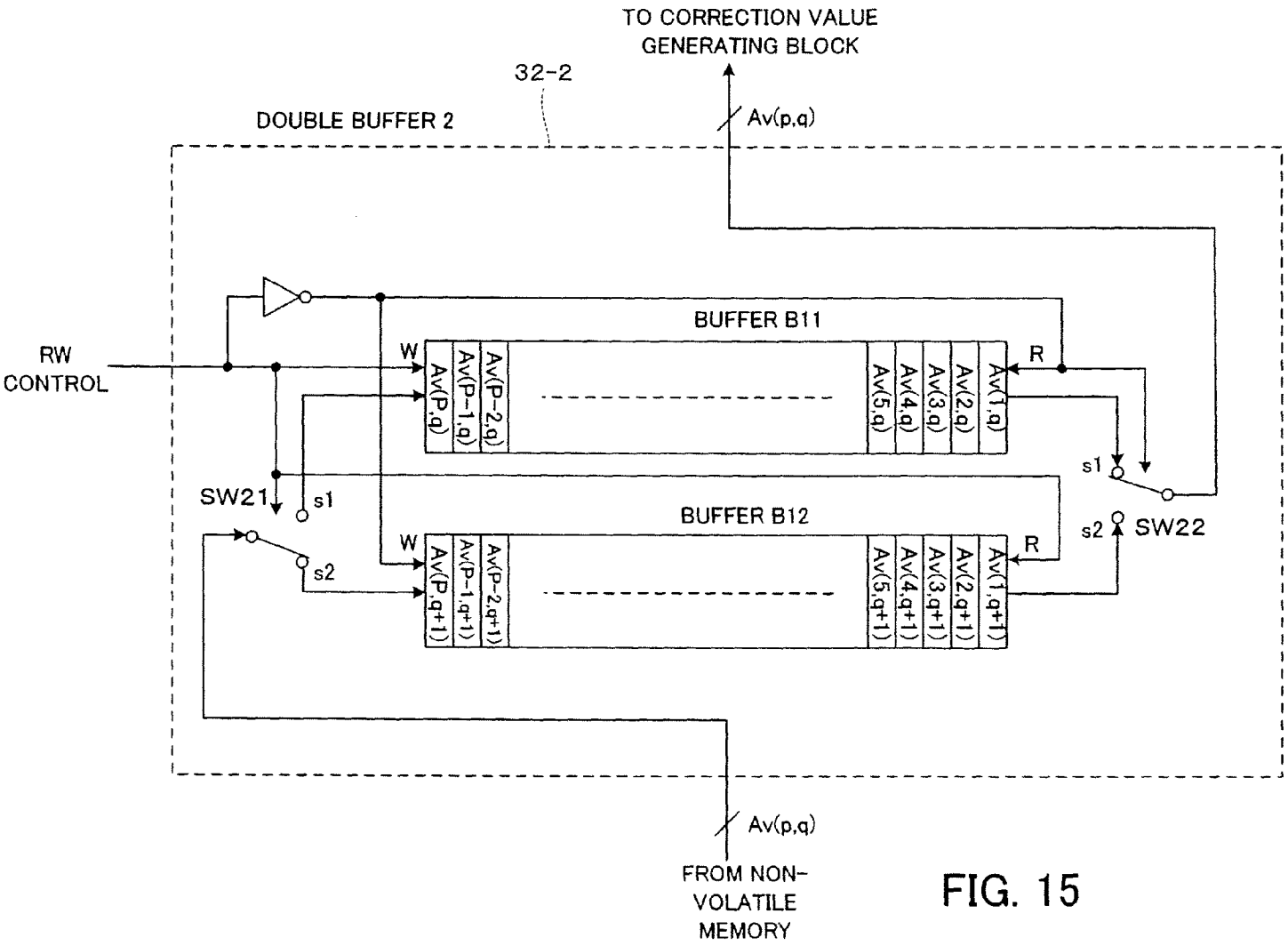
FIG. 15 is a drawing showing the structure of a double buffer 32-2.
Figure 16:
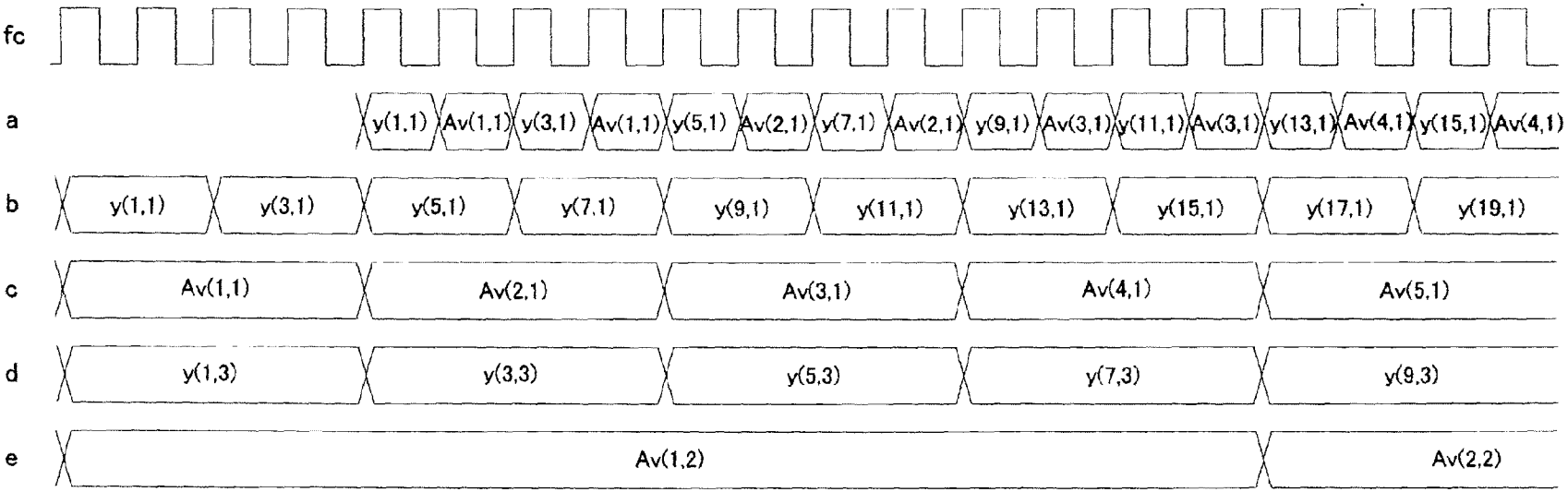
FIG. 16 is a timing chart showing states of signals of each section.

Correction data y(i,j) is read from the flash memory 30-1 into the double buffer 32-1 shown in FIG. 14 at a clock rate of fc/4, while correction values y(i,j) are transmitted from the double buffer 32-1 to the correction value generating block 12*e* at a clock rate of fc/2. Also, average correction data Av(p,q) for small regions is read from the flash memory 30-21 into the double buffer 32-2 shown in FIG. 15 at a clock rate of fc/16, while correction values Av(p,q) are transmitted from the double buffer 32-2 to the correction value generating block 12*e* at a clock rate of fc/2. In the correction value generating block 12*e*, *y*(i,j) and Av(p,q) are alternately sent to the correction calculating blocks 12R, 12G, 12B along the horizontal scanning lines. FIG. 16 shows a data timing relationship for points a to e in FIG. 13, when displaying the first line of frame 1.

In the two horizontal scanning periods for displaying from the beginning pixel of the horizontal line j to the final pixel of the horizontal line (j+1), correction data y(i,j) for the horizontal line (j+2) is read from the flash memory 30-1 to the buffer B12 inside the double buffer 32-1, at a clock rate of fc/4. This corresponds to the line shown as d in FIG. 16, and with this example j=1, so in the two horizontal scanning periods of the first and second lines correction data y(1,3), y(3,3), t(5,3), y(7,3), . . . for pixels of the third line are sequentially read out every other one and written to the buffer B12.

On the other hand, y(1,1), y(3,1), y(5,1), y(7,1), y(9,1), . . . that were written at the time of display of the horizontal lines (j−2) and (j−1) are written to the buffer B11, and at the time of display of horizontal line j and horizontal line (j+1) correction values stored in this buffer B11 are sent sequentially, starting from y(1,1), from the buffer B11 to the correction value generating block 12*e* at a clock rate of fc/2. At this time, the data of the buffer B11 is only used on line j, and is not used on line (j+1).

When displaying the next lines (j+2) and (j+3), the R/W signal is changed over, the buffer B11 is written to, the buffer B12 enters read mode, and at the same time SW11 and SW12 are respectively changed over. Similarly, from then on the R/W signal is changed over every two horizontal lines, and each of the buffers B11 and B12 are repeatedly written to and read from.

On the other hand, during the four horizontal scanning periods for displaying from the beginning pixel of horizontal line j to the final pixel of horizontal line (j+3), average correction data for the small region contained in from horizontal line (j+4) to horizontal line (j+7), namely Av(1, q+1), Av (2, q+1), . . . Av (P, q+1), is read from the flash memory 30-2, and written to the buffer B22 within the double buffer 32-2 at a clock rate of fc/16. In this example, q=1, and so Av(1,1), Av(2,1), Av(3,1), are read. P is the number of small regions in the horizontal direction.

Also, at the time of displaying from horizontal line j to horizontal line (j+3), data for Av(P,q) from Av(1,q) already written in the buffer B21 is sent to the correction value generating block 12*e* at a clock rate of fc/4/Specifically, data of the buffer B21 is repeatedly used across four lines. When displaying the next line (j+7) from (j+4), the R/W signal is changed over, the buffer B21 is written to, the buffer B22 enters read mode, and at the same time SW21 and SW22 are respectively changed over. Similarly, from then on the R/W signal is changed over every four horizontal lines, and each of the buffers B21 and B22 are repeatedly written to and read from.

In this example, two flash memories are used, but it is also possible to store Av and y in one flash memory and reduce the number of memories. In this case, if the bit width of the memory is kept the same, it will be necessary to raise the read clock frequency according to an increase in data amount. With the above described example, it is necessary to read Av once every four times that y is read, which means that the read cock frequency becomes fc/16 at lowest.

The small regions described here can be each horizontal line, or a plurality of pixels on a horizontal line. In this case, there is the advantage that a line buffer is not required, and it is possible to simplify the circuitry.

It is also preferable to divide the display region into small regions of n (n is an integer of 2 or more) unit pixels, and provide a memory for respectively storing average values Av of correction data for those n pixels, and z, derived from computation of the average values Av of correction data for the n pixels, and correction values y for each pixel within the small region. For example, by making a difference, between average value Av and correction value y for each pixel data, z for each pixel, the amount of data to be saved can be reduced. Therefore, for a read out z, it is possible to calculate y for each pixel by performing reverse calculation (for example addition) using Av, and use in correction.

What is claimed is:

1. A display device for displaying frames of video information comprising:

a display panel comprising a plurality of pixels arranged in a pixel matrix, wherein the pixel matrix is divided into regions of 16 adjacent pixels each;

a source driver connected to the display panel to provide data signals to pixels in each column of the pixel matrix;

an inconsistency correction calculation section connected to the source driver for correcting variations in brightness of each pixel;

a memory connected to the inconsistency correction calculation section for storing a correction value for each pixel and an average of correction values for the 16 adjacent pixels of each region, wherein in a group of four frames, for each region, a first group of four pixels are corrected using a stored pixel correction value and 12 pixels, different from the first group of four pixels, are corrected using the average of correction values for the 16 adjacent pixels of the region in a first frame of each group of four frames, a second group of four pixels, different from the first group of four pixels, is corrected using a stored pixel correction value and 12 pixels, different from the second group of four pixels, are corrected using the average of correction values for the 16 adjacent pixels of the region in a second frame of each group of four frames, a third group of four pixels, different from the first group of four pixels and second group of four pixels, is corrected using a stored pixel correction value and 12 pixels, different from the third group of four pixels, are corrected using the average of correction values for the 16 adjacent pixels of the region in a third frame of each group of four frames, and a fourth group of four pixels, different from the first group of four pixels, second group of four pixels and third group of four pixels, is corrected using a stored pixel correction value and 12 pixels, different from the fourth group of four pixels, are corrected using the average of correction values for the 16 adjacent pixels of the region in a fourth frame of each group of four frames.

2. The display device of claim 1, wherein each region comprises 16 adjacent pixels on a row of the pixel matrix.

3. The display device of claim 1, wherein each region comprises a 4×4 matrix of adjacent pixels.

* * * * *